United States Patent [19]

Roccaforte

[11] 4,405,066

[45] Sep. 20, 1983

[54] DISPENSER CARTON WITH IMPROVED END CLOSURE

[75] Inventor: Harry I. Roccaforte, Western Springs, Ill.

[73] Assignee: Champion International Corporation, Stamford, Conn.

[21] Appl. No.: 305,618

[22] Filed: Sep. 25, 1981

[51] Int. Cl.[3] ..... B65D 85/671

[52] U.S. Cl. ..... 225/43; 225/48; 225/91; 206/395; 229/17 S

[58] Field of Search ..... 225/43, 48, 49, 50, 225/91; 206/395, 396; 229/17 S

[56] References Cited

U.S. PATENT DOCUMENTS

| | | | |
|---|---|---|---|
| 1,905,561 | 4/1933 | Gluck | 225/48 |
| 1,922,826 | 8/1933 | Smith | 225/48 X |
| 2,633,985 | 4/1953 | Meyer | 225/48 X |
| 2,717,074 | 9/1955 | Williamson et al. | 225/43 |
| 2,776,052 | 1/1957 | Stevens | 225/49 X |
| 3,137,424 | 6/1964 | Finn et al. | 225/48 |
| 3,974,947 | 8/1976 | Budny | 225/49 X |
| 4,127,229 | 11/1978 | Roccaforte | 225/48 X |
| 4,307,828 | 12/1981 | Sias et al. | 225/48 X |

*Primary Examiner*—Frank T. Yost

*Attorney, Agent, or Firm*—Evelyn M. Sommer; William W. Jones; John H. Mulholland

[57] ABSTRACT

A flip top dispenser carton is provided having improved end closures which may be readily erected on automatic equipment. The end closures are defined by a plurality of end flaps, having complimentary triangular configurations enabling selective adhesive connections to be established between certain flaps. In addition, an improved reinforced straight cutting edge is provided to facilitate cutting of rolls of film such as wax paper and aluminum foil.

25 Claims, 7 Drawing Figures

DISPENSER CARTON WITH IMPROVED END CLOSURE

BACKGROUND OF THE INVENTION

The subject invention relates to a dispenser carton adapted to contain a roll of film such as wax paper, polycoated freezer paper or aluminum foil. The dispenser carton includes a pair of end closures which are readily erected on automatic equipment. In addition, a plastic reinforced straight edge is provided to facilitate cutting of the roll of film.

In the prior art various dispenser cartons have been constructed for containing and dispensing films from a roll housed within. The majority of the early cartons included a tear strip which enabled the sealed box to be opened. More recently, cartons have been developed wherein an outer panel or hood is releasably connected to an inner panel for sealing the carton. When the user wishes to open the carton, the releasable connection is broken enabling the hood of the box to be flipped open.

In the above described flip top hooded cartons end closures are provided having an additional end flap necessary to form the hood. A carton with such an end closure requires packaging equipment that has an extra tucking mechanism for the additional flap. This type of packaging equipment is specifically made for cartons of this style and consequently are more costly than standard equipment. Accordingly, it would be desirable to provide an improved hooded dispenser carton having end closures that effectively seal the carton to preclude contaminants from gaining access to the interior of the box, and which may be readily erected on standard packaging equipment.

Another feature commonly included in the prior art dispenser cartons is a metal, saw-tooth blade. The metal blade is provided to facilitate the cutting of the roll of film in the carton. Recently, in order to reduce costs, the metal blade has been eliminated and a saw-tooth configuration has been provided along a free edge of a panel of the paperboard carton. While the paper saw-tooth configuration provides a satisfactory cutting action with wax paper, a stronger cutting edge would be desirable for films such as clear plastic wraps, polycoated freezer paper, and aluminum foil.

Accordingly, it is an object of the subject invention to provide a new and improved dispenser carton having an end wall structure which precludes contaminants and other unwanted materials from gaining access to the interior of the box.

It is another object of the subject invention to provide a new and improved dispenser carton having an end structure which can readily be opened in a flip top manner.

It is a further object of the subject invention to provide a new and improved dispenser carton that is formed from a single sheet of paperboard and can be readily erected on standard automatic equipment.

It is still another object of the subject invention to provide a new and improved dispenser carton which includes a reinforced straight edge to facilitate the cutting of the roll of film.

SUMMARY OF THE INVENTION

In accordance with these and other objects, the subject invention provides for a dispenser carton having front, bottom, rear and top panels hingedly connected to define an elongated, generally rectangular tube. The dispenser carton further includes an outer panel hingedly connected to the top panel. The outer panel is disposed coplanar with and is releasably connected to the front panel.

In accordance with the subject invention, a pair of unique end closures are provided for sealing the ends of the tube. Each end closure consists of a plurality of flaps which are hingedly connected to the side edges of the panels and disposed in overlapping coplanar relationship, perpendicular to the longitudinal axis of the tube. The end flaps may be rapidly folded on automatic equipment. Some of the flaps are provided with novel complimentary configurations enabling selective adhesive connections to be established between certain flaps, as described more fully hereinbelow. In the preferred embodiment of the subject invention, the complimentary end flaps are triangular in configuration.

In one embodiment of the subject invention, the outer panel extends towards but is spaced from the bottom panel. The longitudinally extending free edge of the outer panel is straight and is provided with a plastic reinforcing strip to facilitate cutting of the roll of film within the carton. The straight reinforced edge is effective in cutting films such as wax paper, polycoated freezer paper and aluminum foil, and is less costly to manufacture than the prior art metal saw-tooth blade.

In an alternative embodiment of the subject invention, the longitudinally extending straight free edge of the outer panel extends below the plane of the bottom panel. In the latter embodiment, the outer panel includes upper and lower segments defined by an intermediate longitudinally extending cut score line. The lower segment is adhesively connected to the front panel. The carton is opened by breaking the cut score line releasing the upper segment while the lower segment remains adhesively connected to the front panel.

Further objects and advantages of the subject invention will become apparent from the following detailed description taken in conjunction with the drawings in which:

DESCRIPTION OF THE PREFERRED EMBODIMENTS

Figure 1:
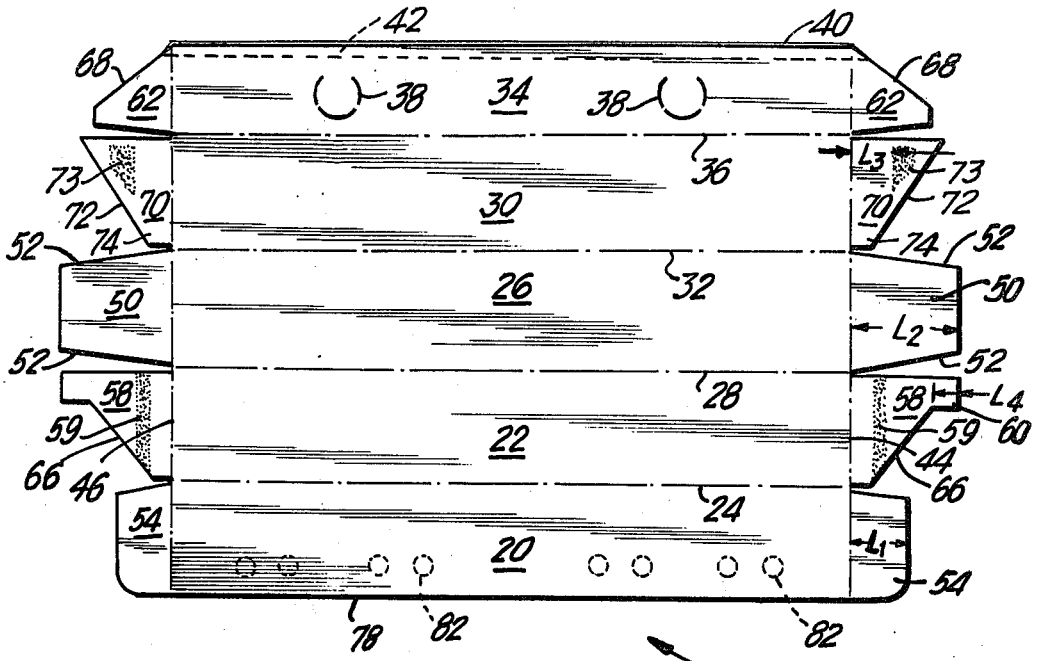
FIG. 1 is a top plan view of the blank for forming the first embodiment of the new and improved dispenser carton of the subject invention.
Figure 2:
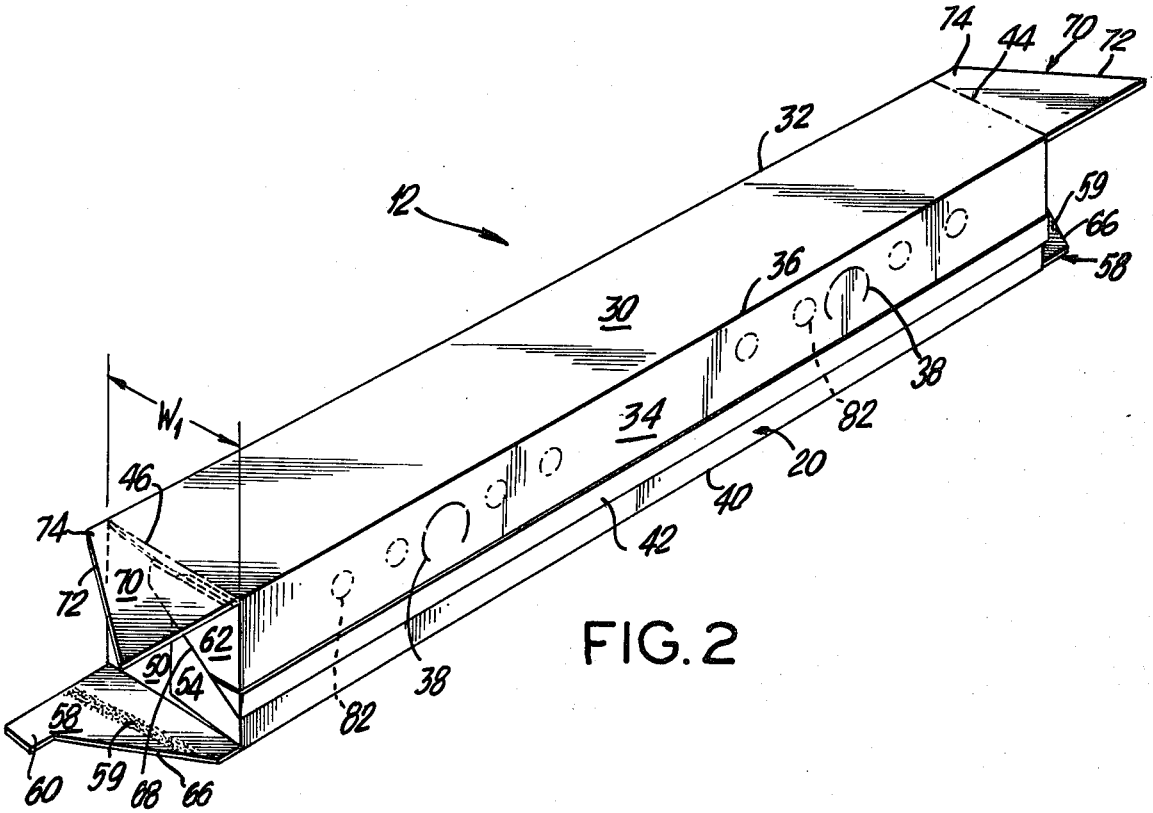
FIG. 2 is a perspective view of the new and improved dispenser carton of the subject invention shown partially erected from the blank of FIG. 1.
Figure 3:
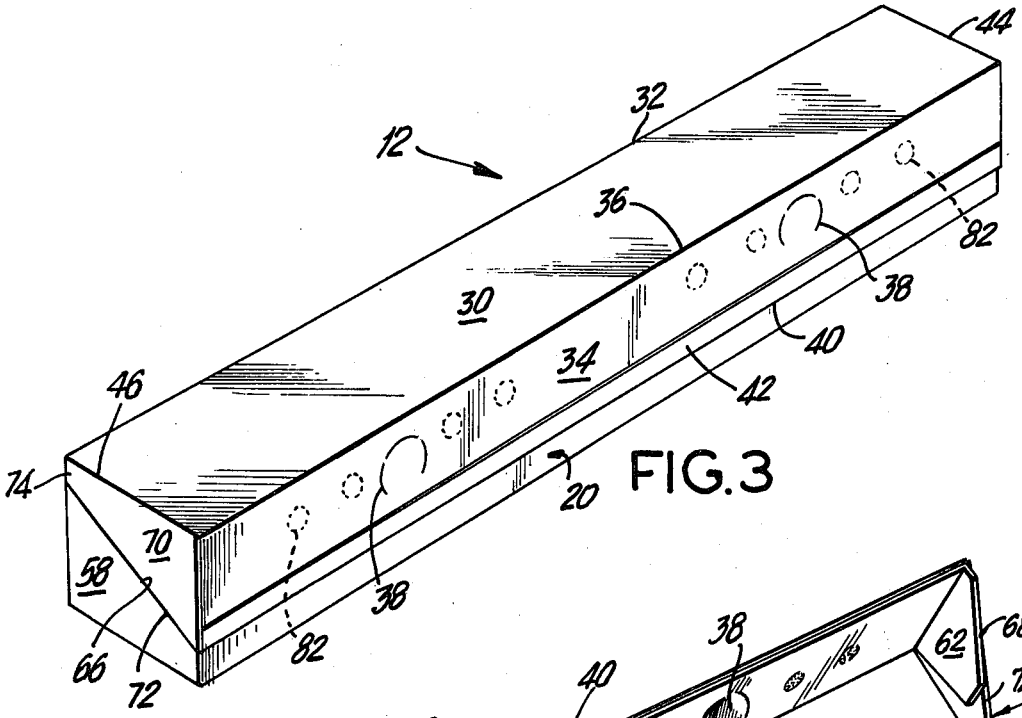
FIG. 3 is a perspective view of the new and improved dispenser carton of the subject invention shown fully erected.
Figure 4:
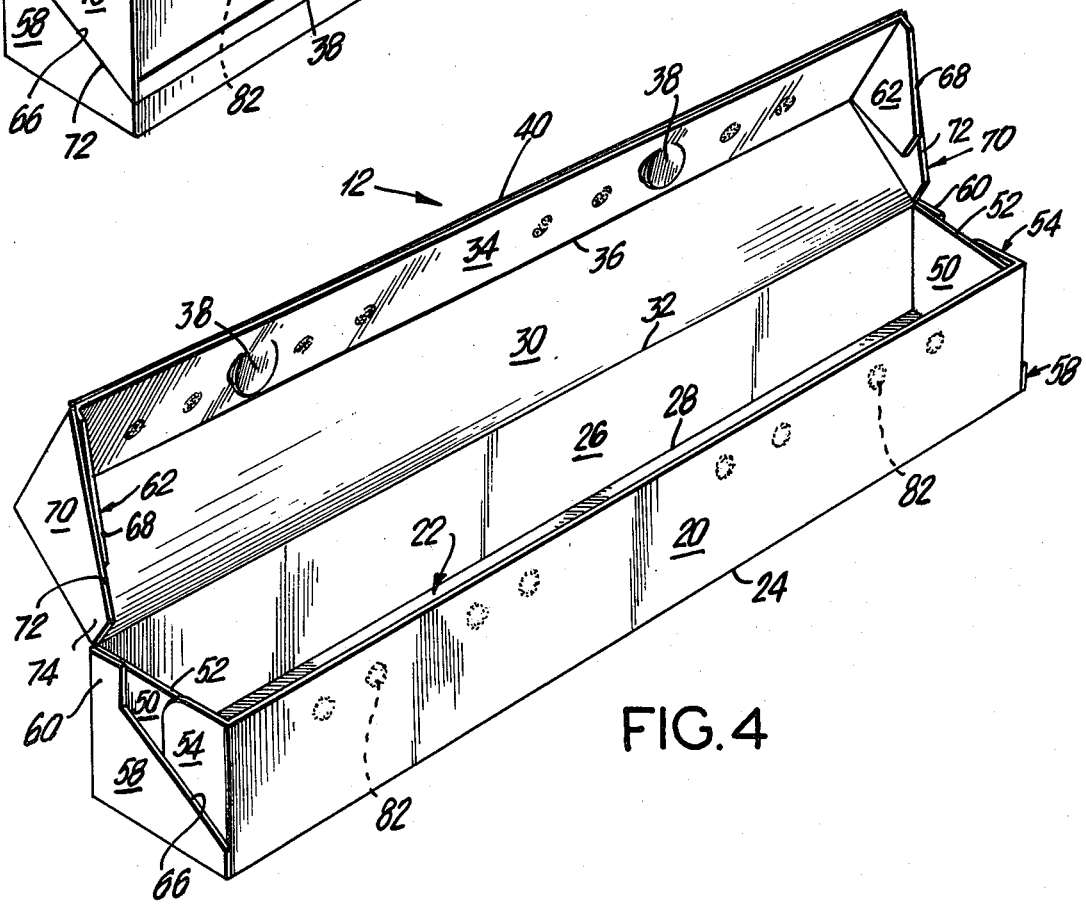
FIG. 4 is a perspective view of the new and improved dispenser carton of the subject invention shown in the open position.

Referring to FIG. 1, there is illustrated a blank 10 for forming the first embodiment of the dispenser carton of the subject invention. The blank 10 is formed from a generally rectangular single sheet of paperboard having a plurality of parallel fold lines defining generally rectangular, main body panels. More specifically, the blank 10 includes a generally rectangular front panel 20 hingedly connected to a bottom panel 22 along fold line 24. Rear panel 26 is hingedly connected to bottom panel 22 along fold line 28, while top panel 30 is hingedly connected to the rear panel 26 along fold line 32. The above described panels may be erected into an elongated, generally rectangular tubular configuration as illustrated in FIGS. 2 through 4. The blank 10 further includes an outer panel 34 which is hingedly connected to the top panel 30 along fold line 36. In the erected carton outer panel 34 overlies and is coplanar with front panel 20. Outer panel 34 is releasably connected via adhesives to front panel 20. Preferably, outer panel 34 is provided with a pair of arcuate cut lines 38 to facilitate the opening of the erected carton.

In the preferred embodiment of the subject invention, the longitudinally extending free edge 40 of outer panel 34 is provided with a reinforcing plastic strip 42. The combination of a straight edge 40 and reinforcing strip 42 provides a rigid cutting surface for tearing heavier rolls of film such as wax paper and aluminum foil. The plastic strip 42 may be attached to either surface of the blank but is preferably orientated such that in the erected carton it is disposed on the outer surface thereof. The reinforcing strip 42 may be added to the blank 10 at low cost during the blank forming operation. More specifically, during manufacture, individual blanks are laid out and stamped from a large sheet of paperboard. Adjacent blanks are arranged in mirror image relationship. Thus, the outer panels of adjacent blanks border one another and are contiguous. By this arrangement, a double width of plastic can be readily applied covering the eventual line of separation between the blanks such that a single cut, defining the free edges 40 of both blanks 10, simultaneously forms the side edges of both plastic strips 42. Accordingly, an improved cutting edge is provided at substantially lower cost than the metal saw-tooth blades heretofore required in the prior art to cut heavier rolls of film.

The subject blank 10 is further provided with a plurality of flaps hingedly connected to the opposed side edges of the blank along fold lines 44 and 46. The unique configuration of the end flaps enables the carton to be rapidly erected on automatic equipment to form secure sealed end closures. Further, due to the novel complimentary configuration of the end flaps, selective adhesive connections can be established therebetween enabling the carton to be opened in a flip top manner.

Each end closure structure is identical and therefore only the flaps comprising one structure will be described in detail. Each end closure includes a first flap 50 hingedly connected to the rear panel 26. The first flap 50 has a generally rectangular configuration which substantially conforms to the cross-sectional area of the erected tube of the carton. Preferably, the opposed side edges 52 of the first flap 50 are tapered inwardly to facilitate folding. Second flap 54 is hingedly connected to front panel 20 and is generally rectangular in configuration. The length L1 of second flap 54 is less than the length L2 of the first flap 50. By this arrangement, in the erected carton, the second flap 54 extends towards but is spaced from the rear panel 26.

Third flap 58 is hingedly connected to bottom panel 22 and is generally triangular in configruation. Preferably, third flap 58 includes a rectangular portion 60 extending away from the hinged connection to the bottom panel 22. Rectangular portion 60 is provided to enhance the sealing of the ends of the erected carton as more fully described hereinafter. Third flap 58 also may be provided with a strip 59 of contact adhesive.

Fourth flap 62 is hingedly connected to outer panel 34 and is generally triangular in configuration. In accordance with the subject invention, the triangular configuration of fourth flap 62 is complimentary to the triangular configuration of third flap 58. Accordingly, in the erected carton, the third and fourth flaps do not overlap but the angled side edges 66 and 68 thereof are disposed in aligned, abutting relationship.

Fifth flap 70 is hingedly connected to top panel 30 and is generally triangular in configuration. The triangular configuration of fifth flap 70 is also complimentary to the configuration of third flap 50. Similar to the third and fourth flaps, in the erected carton, the third and fifth flaps do not overlap but rather, the angled side edges 66 and 72 thereof are disposed in aligned and abutting relationship. Fifth flap 70 is provided with a strip 73 of contact adhesive. In the preferred embodiment of the subject invention, wherein third flap 58 includes rectangular portion 60, when the carton is erected there will be some overlap between the third and fifth flaps adjacent the apex portion 74 of the latter. This overlap functions to add rigidity to the end closure structures.

The blank 10, as illustrated in FIG. 1, may be readily erected into a dispenser carton 12 on automatic equipment. More specifically, bottom and front panels 22, 20 are initially folded about hinge line 28 into coplanar relationship with the remainder of the blank. Thereafter, outer panel 34 is folded about hinge line 36 into overlying coplanar relationship with front panel 20. Outer panel 34 is releasably connected to the front panel 20 via a plurality of discrete adhesive connections, indicated in phantom in FIG. 2. The panels of the blank 10 are then separated and rotated to define an elongated, generally rectangular tubular configuration. The film product is then loaded into the carton prior to the sealing of end closure structures.

Each end closure of the subject carton 12 is formed by folding the end flaps into overlapping, coplanar relationship, perpendicular to the longitudinal axis of the tube. Due to the unique configuration and orientation of the five end flaps, only four sequential folding steps are required to produce an end closure structure which fully seals the carton such that need for packaging equipment having an extra tucking mechanism is eliminated.

As illustrated in FIGS. 2 and 3, the end closure is formed by initially rotating first flap 50 into a position perpendicular to the longitudinal axis of the tube. Since the dimensions of first flap 50 substantially conform to the cross-sectional area of the tube, the first flap functions as the primary sealing means of the carton. In the second folding step, both the second and the fourth flaps 54, 62 may be simultaneously folded. More specifically, and as discussed above, in the erection of the tube, the front and outer panels 20, 34 are disposed in coplanar relationship. As a result, both the second and fourth flaps 54, 62 are also disposed in overlapping coplanar relationship. Accordingly, during the second folding step, the automatic machinery places a biasing force on the overlying fourth flap 62 causing both the second and fourth flaps to be simultaneously folded into overlapping relationship with first flap 50. Thus to achieve the configuration illustrated in FIG. 2, only two automatic folding steps are required. At this point in the folding sequence, no adhesive connections between the end flaps have been made.

In the subsequent folding step, third panel 58 is rotated about hinge line 44 into coplanar relationship with third flap 62, overlying first and second flaps 50 and 54. As can be appreciated, the complimentary triangular configurations of third and fourth flaps 58, 62 precludes any overlap to occur therebetween. Rather, third flap 58 overlaps only first and second flaps 50 and 54 and is adhesively connected thereto along glue strip 59. In order to insure that third flap 58 is adhesively connected to both first and second flaps 50 and 54 respectively, it is necessary that the length L1 of second flap 54 be less than the width W1, separating the front and rear panels 20, 26 (which corresponds to the length L2 of first flap 50, as discussed above). By this arrangement, second flap 54 extends towards but is spaced from rear panel 26 leaving some portion of first flap 50 uncovered, thereby permitting an adhesive connection to be established between the first and third flaps. The overlying and adhesively connected first, second and third flaps function to fully seal the end of the carton 12.

The final closure of the carton is achieved by rotating fifth flap 70 into overlapping relationship with fourth flap 62. As illustrated in FIG. 3, due to the complimentary configurations between third and fifth flaps 58 and 70 respectively, there is no overlap between the angled edges 66 and 72 thereof. Fifth flap 70 is bonded to the fourth flap via glue strip 73.

As discussed above, in the preferred embodiment of the subject invention, third flap 58 includes a rectangular portion 60 which extends upwardly towards top panel 30 and is overlapped by fifth flap 70. This overlap functions to provide additional rigidity to the closure structure and inhibit the inadvertent separation between the adhesively connected first, second and third flaps. However, in order to insure that the carton can be freely opened, it is necessary to prevent any adhesive connection between third and fifth flaps 58, 70. Accordingly, glue strip 73 is placed on fifth flap 70 a distance L3, measured from fold line 44, which is greater than the length L4 of rectangular portion 60, as illustrated in FIG 1. By this arrangement, no portion of the adhesive strip will contact rectangular portion 60 of third flap 58.

The subject carton 12 sealed in accordance with the subject invention may now be shipped and displayed for retail sale. After purchase, the user can readily open the carton 12 in a flip top manner without using tear strips or having to tear an end flap as in the prior art cartons. More specifically, in order to open the carton 12, the user presses inwardly at arcuate cut lines 38 of outer panel 34 in order to break the releasable connection between outer panel 34 and front panel 20. Once the adhesive connection is released, top panel 30 may be rotated upwardly about fold line 32. As illustrated in FIG. 4, since the fourth and fifth flaps 62 and 70 are adhesively connected only to each other, they will rotate simultaneously along with outer and front panels 34 and 20 respectively. The adhesive connection between the fourth and fifth flaps rigidifies the lid structure during the life of the carton 12. More specifically, when the roll of film is to be torn, the rigid connection between the fourth and fifth flaps functions to firmly maintain the orientation of the outer panel during the cutting operation.

In use, after the cover of the carton 12 has been opened, the desired length of film from the roll is drawn outwardly. In order to tear the film, it is preferable to reclose the carton such that the outer and front panels are again in coplanar and abutting relationship. The roll of film is then pulled upwardly causing it to tear along reinforced straight edge 40. As discussed above, the reinforced straight edge is relatively inexpensive to produce and is capable of cutting heavier films such as wax paper and aluminum foil.

It is to be understood that while in the preferred embodiment of the subject invention, the complimentary configurations of the end flaps are angled, they may be provided with other complimentary configurations. For example, horizontal straight edges could be used by properly regulating the length of the flaps.

Figure 5:
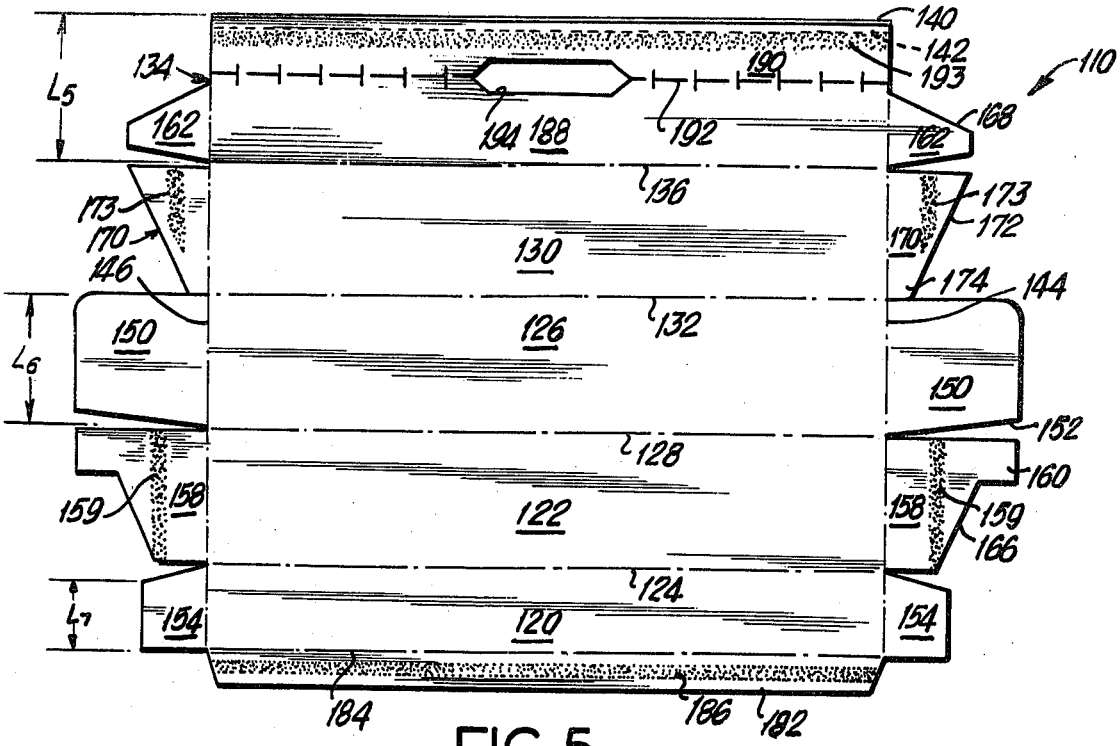
FIG. 5 is a top plan view of a blank for forming an alternate embodiment of the dispenser carton of the subject invention.

Referring to FIG. 5, there is illustrated a blank 110 for forming an alternate embodiment of the dispenser carton 112 of the subject invention. The alternate embodiment includes the reinforced straight cutting edge and the unique end closure structures of the first embodiment, with similar parts having similar numbers indexed upwardly by 100. More specifically, blank 110 includes front, bottom, rear and top panels 120, 122, 126 and 130 respectively, hingedly connected between fold lines 124, 128 and 132. Front panel 120 additionally includes a reinforcing segment 182 defined by a longitudinally extending intermediate fold line 184. Reinforcing segment 182 is provided with a strip 186 of contact adhesive. Reinforcing segment 182 functions to strengthen front panel 120 thereby inhibiting deformation during the tearing of the film, as described more fully hereinbelow.

Outer panel 134 is hingedly connected to top panel 130 along fold line 136. The arcuate score lines 38, as provided in the first embodiment, are not utilized in the second embodiment of the subject invention. In contrast, outer panel 134 is longer or extends away from fold line 136 an additional distance, and is divided into upper and lower segments 188 and 190 by cut score line 192. The total length L5 of outer panel 134 is slightly greater than the length L6 of rear panel 126 such that in the erected carton, the free edge 140 of the former projects below the plane of the bottom panel 122. Lower segment 190 is provided with a longitudinally extending strip 193 of contact adhesive.

Free edge 140 of outer panel 134 is straight and provided with a reinforcing plastic strip 142. The attachment and manufacture of the reinforcing strip 142 is identical with the procedure used in forming the blank of the first embodiment of the subject invention and need not be further described. Outer panel 134 is additionally provided with an aperture 194 which is preferably centrally located and contiguous with cut score line 192. Aperture 194 is provided to facilitate the opening of the carton.

Similar to the first embodiment of the subject invention, a pair of end closure structures are provided, defined by a plurality of closure flaps hingedly connected along opposed fold lines 144 and 146 respectively. Each closure structure includes first flap 150, second flap 154, third flap 158, fourth flap 162 and fifth flap 170. The configurations of the flaps are identical with the configurations of the flaps in the first embodiment with the exception of second flap 154. More specifically, the length L7 of second flap 154 is reduced to permit the folding of reinforcing segment 182 during the erection of the carton.

Figure 6:
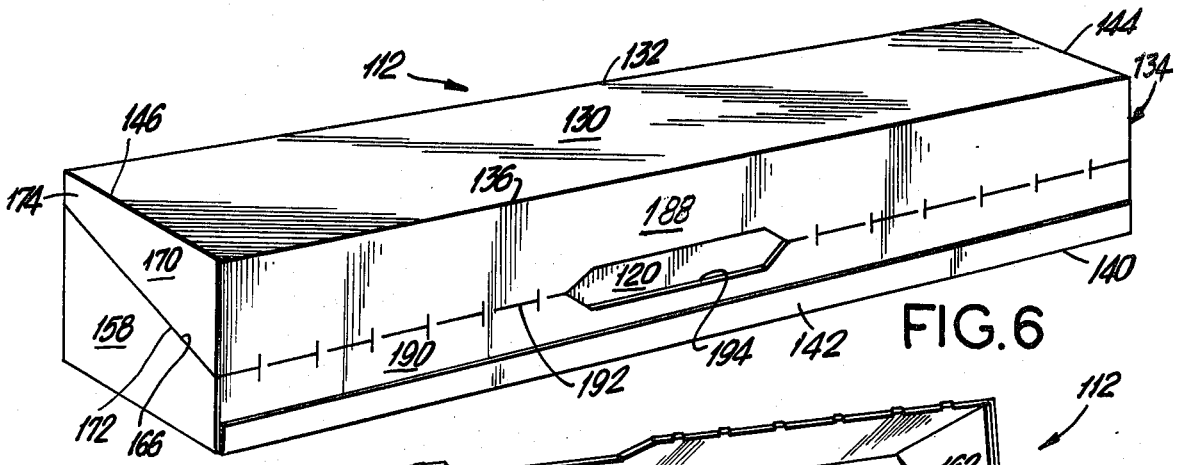
FIG. 6 is a perspective view of the alternate embodiment of the dispenser carton of the subject invention shown fully erected.
Figure 7:
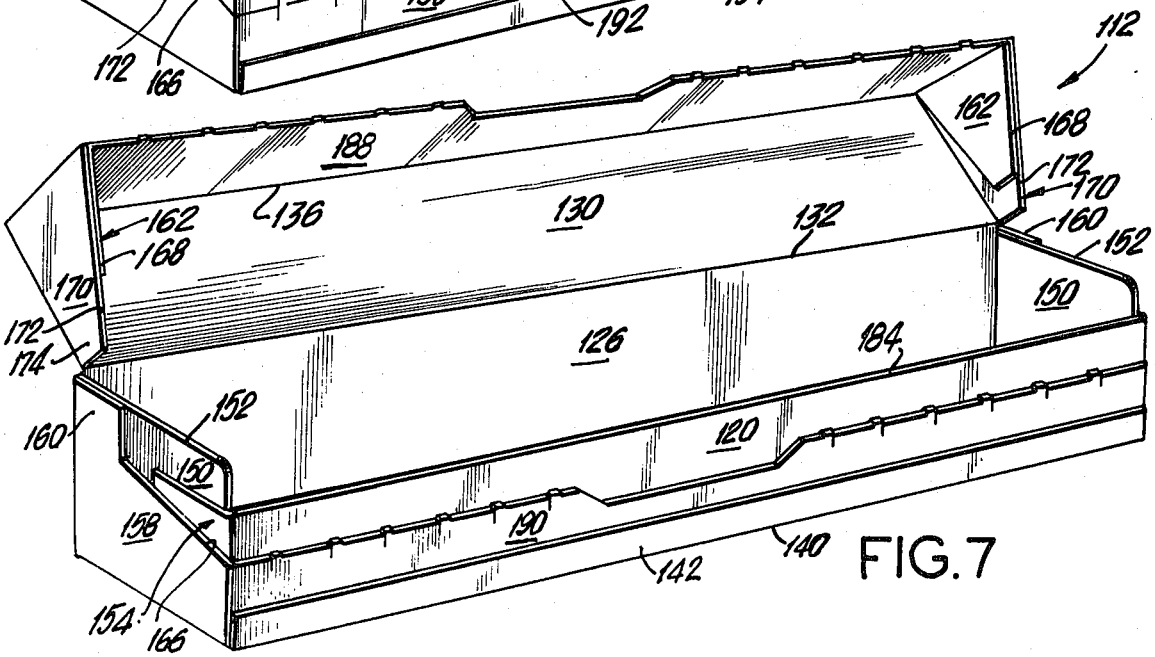
FIG. 7 is a perspective view of the alternate embodiment of the new and improved dispenser carton of the subject invention shown in the open position.

The blank 110 illustrated in FIG. 5, may be readily erected on automatic equipment to form the carton, illustrated in FIGS. 6 and 7. In the erection of the second embodiment of the subject invention, reinforcing segment 182 is initially folded about hinge line 184 and is adhesively connected to front panel 120 via glue strip 186. This folding step functions to define a two-ply, reinforced edge along hinge line 184, as illustrated in FIG. 7. The bottom and front panels 122, 120 are then folded about hinge line 128 into coplanar relationship with the remainder of the blank. Outer panel 134 may then be folded into overlying relationship with front panel 120 such that the lower segment 190 of the former may be adhesively connected to the front panel 120, along glue strip 193. The panels of the blank 110 are then separated and rotated to define an elongated, generally rectangular, tubular configuration. In accordance with the second embodiment of the subject invention, the free edge 140 of outer panel 134 projects below the plane of bottom panel 122, as illustrated in FIG. 6. The film product may then be loaded into the carton 112 with the end closure structures being sealed thereafter in a manner identical with the first embodiment of the subject invention.

In order to open the carton 112 to dispense the contents thereof, cut score line 192 must be broken. More specifically, the user may insert a finger into aperture 194 to facilitate the biasing of upper segment 188, of outer panel 134, away from the front panel 120. Lower segment 190 remains adhesively connected to the front panel. The lid of the carton can then be rotated upwardly about fold line 132 to permit the dispensing of the roll of film within the carton. In use, the desired length of film is drawn out of the carton downwardly towards reinforced straight edge 140. Preferably, the carton lid is reclosed. The strip of film may be readily cut by pulling the film towards the bottom of the carton and tearing along the downwardly projecting reinforced straight edge 140. As can be appreciated, the downward pulling force on the film will exert a considerable amount of pressure on the free edge 184 of front panel 120. Accordingly, the provision of the reinforced free edge 184 functions to prevent deformation of the carton during use.

In summary, there has been provided a new and improved dispenser carton having a unique end closure structure for sealing the carton. Each end closure structure is defined by a plurality of flaps which are hingedly connected to the opposed side edges of the carton and are disposed in overlapping coplanar relationship, perpendicular to the longitudinal axis of the tube. The end flaps, which may be rapidly folded on automatic equipment are provided with novel, complimentary configurations enabling selective adhesive connections to be established between certain flaps. In the preferred embodiment, the end flaps have a complimentary triangular configuration. By this arrangement, a hooded carton is defined that can be erected on standard automatic equipment and which can be opened in a flip to manner. The subject invention is further provided with an improved, reinforced straight edge which is capable of cutting heavier films such as wax paper and aluminum foil.

While the subject invention has been described with reference to preferred embodiments, it is apparent that various changes and modifications may be made therein, by one skilled in the art, without departing from the scope and spirit of the subject invention as defined by the appended claims.

What is claimed is:

1. A dispenser carton having end closures sealable on automatic equipment comprising:

front, buttom, rear and top panels hingedly connected in series to define an elongated, generally rectangular tube and further including an outer panel hingedly connected to said top panel and disposed in contiguous relationship with said front panel and being releasably connected to said front panel externally of said tube; and a pair of opposed end closures for sealing the ends of said tube, with each said end closure including a plurality of flaps hingedly connected to the side edges of said panels and being disposed in overlapping relationship, perpendicular to the longitudinal axis of said tube, each said end closure including, a first flap hingedly connected to said rear panel and having a generally rectangular configuration substantially conforming to the rectangular cross section of said tube;

a second flap hingedly connected to said front panel and overlying said first flap, said second flap being generally rectangular in configuration extending towards but spaced from said rear panel, a third flap hingedly connected to said bottom panel and having a generally triangular configuration, with one leg of said triangle being substantially parallel to said hinged connection between said first flap and said rear panel, said third flap overlying a portion of each of said first and second flaps and being adhesively connected thereto;

a fourth flap hingedly connected to said outer panel and having a generally triangular configuration, said triangular configuration being complimentary to said triangular third flap, said fourth flap overlying said first and second flaps, and a fifth flap hingedly connected to said top panel and being generally triangular in configuration, with one leg of said triangle being substantially parallel to said hinged connection between said outer panel and said fourth flap, said triangular configuration being complimentary to said triangular third flap, said fifth flap overlying said fourth flap and being adhesively connected thereto whereby when said end closure is erected, said second and fourth flaps may be simultaneously folded over said first flap, prior to the folding of said third and fifth flaps such that the number of folding steps to erect said end closure is reduced, said carton being openable by breaking the releasable connection between said front and outer panels enabling said top panel and outer panels to be rotated about said hinged connection between said top and rear panels with said fourth and fifth panels being rotated therewith.

2. A dispenser carton as recited in claim 1 wherein the opposed side edges of said first flap are tapered to facilitate the erection of said end closures.

3. A dispenser carton as recited in claim 1 wherein said third flap includes a rectangular portion extending towards said top panel, said rectangular portion underlying said fifth flap thereby rigidifying said end closure.

4. A dispenser carton as recited in claim 1 wherein the longitudinally extending free edge of said outer panel is straight, said straight edge being reinforced by a plastic strip.

5. A dispenser carton as recited in claim 4 wherein said outer panel extends towards but is spaced from said bottom panel.

6. A dispenser carton as recited in claim 4 wherein said reinforced straight edge of said outer panel extends below the plane of said bottom panel.

7. A dispenser carton as recited in claim 6 wherein said outer panel includes upper and lower segments defined by an intermediate, longitudinally extending cut score line, with said lower segment being adhesively connected to said front panel, said carton being openable by breaking said cut score line thereby releasing said upper segment with said lower segment remaining adhesively connected to said front panel.

8. A dispenser carton as recited in claim 7 wherein said outer panel further includes an aperture, contiguous with said cut score line to facilitate the tearing of said cut score line during the opening of said carton.

9. A dispenser carton as recited in claim 7 wherein said front panel includes a reinforcing segment hingedly connected adjacent the free edge thereof, said reinforcing segment being folded into coplanar relationship with said front panel and adhesively connected thereto to define a reinforced edge.

10. A dispenser carton having end closure sealable on automatic equipment comprising:

front, bottom, rear and top panels hingedly connected in series to define an elongated, generally rectangular tube and further including an outer panel hingedly connected to said top panel and disposed in contiguous relationship with said front panel, with said outer panel being connected to said front panel externally of said tube, and with a longitudinally extending free edge of said front panel being straight, said straight edge being reinforced by a plastic strip; and a pair of opposed end closures for sealing the ends of said tube, with each said end closure including a plurality of flaps hingedly connected to the side edges of said panel and being disposed in overlapping relationship, perpendicular to the longitudinal axis of said tube, each said end closure including, a first flap hingedly connected to said rear panel and having a generally rectangular configuration substantially conforming to the rectangular cross section of said tube, a second flap hingedly connected to said front panel and overlying said first flap, said second flap being generally rectangular in configuration extending towards but spaced from said rear panel, a third flap hingedly connected to said bottom panel and having a generally triangular configuration, with one leg of said triangle being substantially parallel to said hinged connection between said first flap and said rear panel, said third flap overlying a portion of each of said first and second flaps and being adhesively connected thereto, a fourth flap hingedly connected to said outer panel and having a generally triangular configuration, said triangular configuration being complimentary to said triangular third flap, said fourth flap overlying said first and second flaps, and a fifth flap hingedly connected to said top panel and being generally triangular in configuration, with one leg of said triangle being substantially parallel to said hinged connection between said outer panel and said fourth flap, said triangular configuration being complimentary to said triangular third flap, said fifth flap overlying said fourth flap and being adhesively connected thereto whereby when said end closure is erected, said second and fourth flaps may be simultaneously folded over said first flap, prior to the folding of said third and fifth flaps such that the number of folding steps to erect said end closure is reduced, said carton being openable by breaking the connection between said front and outer panels enabling said top panel and outer panels to be rotated about said hinged connection between said top and rear panels, said fourth and fifth panels being rotated therewith.

11. A dispenser carton as recited in claim 10 wherein said outer panel is releasably connected to said front panel and extends towards but is spaced from said bottom panel.

12. A dispenser carton as recited in claim 10 wherein said outer panel includes upper and lower segments defined by an intermediate longitudinally extending cut score line, with said lower segment being adhesively connected to said front panel, said carton being openable by breaking said cut score line thereby releasing said upper segment while said lower segment remains adhesively connected to said front panel.

13. A dispenser carton as recited in claim 12 wherein said outer panel further includes an aperture contiguous with said cut score line to facilitate the tearing of said cut score line during the opening of said carton.

14. A dispenser carton having end closures sealable on automatic equipment comprising:

front, bottom, rear and top panels hingedly connected in series to define an elongated, generally rectangular tube and further including an outer panel hingedly connected to said top panel and disposed in contiguous relationship with said front panel and being releasably connected to said front panel externally of said tube; and a pair of opposed end closures for sealing the ends of said tube, with each said end closure including a plurality of flaps hingedly connected to the side edges of said panels and being disposed in overlapping relationship, perpendicular to the longitudinal axis of said tube, each said end closure including, a first flap hingedly connected to said rear panel and having a generally rectangular configuration substantially conforming to the rectangular cross section of said tube;

a second flap hingedly connected to said front panel and overlying said first flap, said second flap being generally rectangular in configuration extending towards but spaced from said rear panel, a third flap hingedly connected to said bottom panel and extending towards but spaced from said top panel, said third flap overlying a portion of each of said first and second flaps and being adhesively connected thereto;

a fourth flap hingedly connected to said outer panel and having a configuration complimentary to said third flap, such that said fourth flap overlies only said first and second flaps, and a fifth flap hingedly connected to said top panel and extending towards but spaced from said bottom panel with the opposed free end of said fifth flap having a configuration complimentary to the free end of said third flap, such that said fifth flap overlies only said fourth flap and is adhesively connected thereto whereby when said end closure is erected, said second and fourth flaps may be simultaneously folded over said first flap, prior to the folding of said third and fifth flaps such that the number of folding steps to erect said end closure is reduced, said carton being openable by breaking the releasable connection between said front and outer panels enabling said top panel and outer panels to be rotated about said hinged connection between said top and rear panels with said fourth and fifth panels being rotated therewith.

15. A dispenser carton as recited in claim 14 wherein said third flap is generally triangular in configuration, with one leg of said triangle being substantially parallel to said hinged connection between said first flap and said rear panel, and wherein said fourth flap is generally triangular in configuration, said triangular configuration being complimentary to said triangular third flap, and wherein said fifth flap is generally triangular in configuration with one leg of said triangle being substantially parallel to said hinged connection between said outer panel and said fourth flap, said triangular configuration being complimentary to said triangular third flap.

16. A paperboard blank for forming a dispenser carton having end closures sealable on automatic equipment comprising:

generally rectangular front, bottom, rear, top and outer panels hingedly connected in series; and two sets of end closure flaps for sealing the ends of the erected carton, each set of end closure flaps being respectively hingedly connected to the opposed side edges of said blank, with each said set including, a first flap hingedly connected to said rear panel and having a generally rectangular configuration, a second flap hingedly connected to said front panel, said second flap being generally rectangular in configuration and extending away from said front panel a distance less than the width of said top and bottom panels, a third flap hingedly connected to said bottom panel and having a generally triangular configuration, with one leg of said triangle being substantially colinear with said hinged connection between said bottom and rear panels, a fourth flap hingedly connected to said outer panel and having a generally triangular configuration, with one leg of said triangle being substantially colinear with the hinged connection between said top and outer panels, said triangular configuration being complimentary to said triangular configuration of said third flap, and a fifth flap hingedly connected to said top panel and being generally triangular in configuration, with one leg of said triangle being substantially colinear with the hinged connection between said top and outer panels, said triangular configuration being complimentary to said triangular third flap.

17. A blank as recited in claim 16 wherein the opposed side edges of said first flap are tapered.

18. A blank as recited in claim 16 wherein said third flap includes a rectangular portion extending away from said bottom panel.

19. A blank as recited in claim 16 wherein said longitudinally extending free edge of said outer panel is straight, said straight edge being reinforced by a plastic strip.

20. A blank as recited in claim 19 wherein the width of said outer panel, measured along an imaginary line perpendicular to the hinged connection to said top panel, is less than the width of said rear panel.

21. A blank as recited in claim 19 wherein the width of said outer panel measured along an imaginary line perpendicular to the hinged connection to said top panel is greater than the width of said rear panel.

22. A blank as recited in claim 21 wherein said outer panel includes upper and lower segments defined by an intermediate longitudinally extending cut score line.

23. A blank as recited in claim 22 wherein said outer panel further includes an aperture contiguous with said cut score line.

24. A blank as recited in claim 22 wherein said front panel includes a reinforcing segment hingedly connected adjacent the free edge thereof, said reinforcing segment being defined by a longitudinally extending fold line.

25. A paperboard blank for forming a dispenser carton having end closures sealable on automatic equipment comprising:

generally rectangular front, bottom, rear, top and outer panels hingedly connected in series; and two sets of end closure flaps for sealing the ends of the erected carton, each set of end closure flaps respectively hingedly connected to the opposed side edge of said blank, with each set including, a first flap hingedly connected to said rear panel and having a generally rectangular configuration, a second flap hingedly connected to said front panel, said second flap being generally rectangular in configuration and extending away from said front panel a distance less than the width of said top and bottom panels, a third generally triangular flap hingedly connected to said bottom panel, said third flap extending away from said bottom panel a distance less than the width of said rear panel, and one leg of said triangular third flap being substantially colinear with the hinged connection between said bottom and rear panels, a fourth generally triangular flap hingedly connected to said outer panel and having a configuration complimentary to said third flap, said fourth triangular flap having one leg which is substantially colinear with the hinged connection between said top and outer panels; and a fifth generally triangular flap hingedly connected to said top panel, said fifth flap extending away from said top panel a distance less than the width of said rear panel, said triangular fifth flap having a configuration complimentary to said third flap, and said fifth triangular flap having one leg which is substantially colinear with the hinged connection between said top and outer panels.

* * * * *